United States Patent [19]

Geddings

[11] Patent Number: 5,055,007

[45] Date of Patent: Oct. 8, 1991

[54] OVER-RIDE VALVE ASSEMBLY FOR AIR OPERATED DOUBLE DIAPHRAGM PUMPS

[76] Inventor: Warren E. Geddings, P.O. Box 1474, Monroe, N.C. 28110

[21] Appl. No.: 492,962

[22] Filed: Mar. 13, 1990

[51] Int. Cl.[5] ..... F04B 43/06

[52] U.S. Cl. ..... 417/393; 91/283; 91/307; 91/319; 91/329

[58] Field of Search ..... 91/283, 307, 319, 329; 417/393

[56] References Cited

U.S. PATENT DOCUMENTS 4,339,985 7/1982 Wilden ..... 91/307

*Primary Examiner*—Gerald A. Michalsky

*Attorney, Agent, or Firm*—Clifton Ted Hunt

[57] ABSTRACT

An over-ride valve assembly is mounted between the actuator valve and center section of an air operated double diaphragm pump to provide normal communication between the actuator valve and the center section of the pump during normal operation of the pump. The over-ride valve assembly has internal passageways extending through normally closed valves to both ends of a valve spool within the actuator valve. The valves may be manually opened to restart a stalled pump by momentarily diverting pressurized air from the diaphragm and directing the pressurized air to the ends of the valve spool to reactivate the valve spool and start the pump.

4 Claims, 3 Drawing Sheets

OVER-RIDE VALVE ASSEMBLY FOR AIR OPERATED DOUBLE DIAPHRAGM PUMPS

FIELD OF THE INVENTION

This invention relates to air operated double diaphragm pumps, and more specifically to an over-ride valve assembly which is easily installed on existing and original equipment, and which is manually operable by pushing a button when necessary to easily and effectively reactivate a stalled pump.

BACKGROUND OF THE INVENTION

Air operated double diaphragm pumps include air driven diaphragms positioned on each side of the center section of the pump and are commonly used in industry to pump a variety of substances, including paint, peanut butter, sludge, abrasive chemicals, etc.

Pressurized air from an air compressor or other source of pressurized air enters the pump through an actuator valve and passes into the center section of the pump. The air will then be directed to an air chamber on the air side of one of the diaphragms, depending on the position of the reciprocable valve spool within the actuator valve. The valve spool reciprocates constantly during operation of the pump to alternately direct air against the air sides of opposed diaphragms.

The two diaphragms are mechanically connected by a control rod passing through the center section of the pump. As one diaphragm outwardly expands under pressure of the air and expels slurry from the slurry side of that diaphragm, the control rod pulls the other diaphragm inwardly to draw slurry into the slurry side of said other diaphragm. The process is repeated as long as the valve spool reciprocates within the actuator valve.

The valve spool sometimes stalls, and the pump stops, because of foreign matter in the air supply or fluctuation of the air pressure. When pressurized air remains in the pump, the usual remedy for a stalled actuator valve is to bang on the actuator valve in an effort to free the valve spool. This is sometimes successful but it is hard on the pump.

U.S. Pat. No. 4,339,985 issued July 20, 1982 to Wilden for AIR DRIVEN RECIPROCATING DEVICE shows one device for reducing the risk of the valve spool stalling, but it is not entirely successful.

SUMMARY OF THE INVENTION

According to the present invention, a stalled valve spool in an air operated double diaphragm pump of the type described may be easily restarted by momentarily directing a burst of pressurized air against one end of the stalled valve spool. The blast of air moves the valve spool from its stalled position and allows resumption of the normal cycle of operations.

The redemptive blast of air is provided through an over-ride valve assembly which may be easily assembled between the actuator valve and the center section of an existing air operated double diaphragm pump. It also may be readily installed as original equipment on new pumps.

The over-ride valve assembly has a housing with passageways through it which remain open and provide normal and constant communication between the the actuator valve and the air sides of the diaphragms.

Additionally, the over-ride valve assembly includes two normally closed, manually operable two-way air valves. One such valve is machined into each end of the housing of the over-ride valve assembly and is connected by internal passageways to the pressure ports and pilot return ports for corresponding ends of the actuator valve.

In the event the pump stalls, one or both of the normally closed two-way air valves may be manually opened to deliver the full pressure of the air system to one or both ends of the valve spool to set it in motion and thereby easily restart the pump.

DETAILED DESCRIPTION OF THE PREFERRED EMBODIMENT OF THE INVENTION

Figure 3:
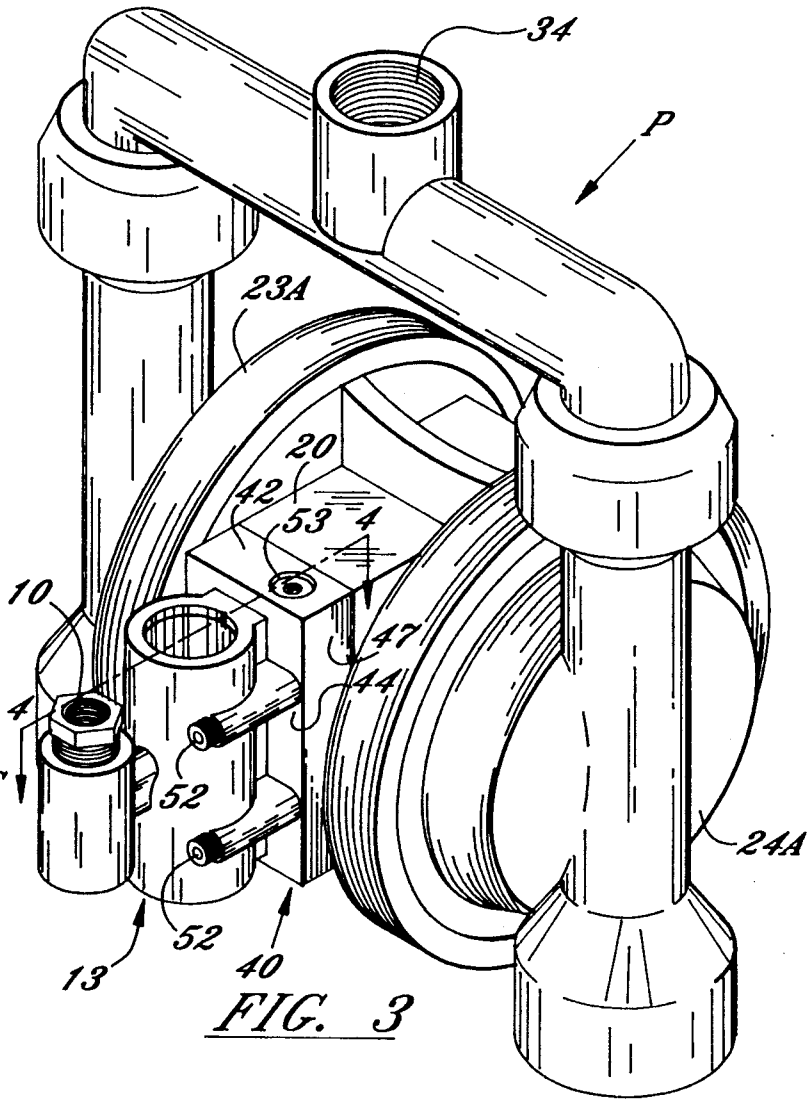
FIG. 3 is a perspective view of an air operated double diaphragm pump with the over-ride valve of this invention mounted for use between the actuating valve and the center section of the pump.

The concept of the over-ride valve assembly of this invention as described and claimed herein is applicable to all air operated double diaphragm pumps. The over-ride valve assembly is described, for the purpose of illustration only, in association with the air operated double diaphragm pump manufactured by Wilden Pump & Engineering Co., 22069 Van Buren Street, Colton, Calif. 92324 as its Model M4 pump. The, operation of the Wilden Model M4 air operated double diaphragm pump is the same as the operation of the pump described herein and illustrated in the accompanying drawings.

Only so much of the structure and operation of the Wilden Model M4 pump as is helpful to an understanding of the structure and function of the over-ride valve of this invention will be set forth here. A more detailed description of the operation of double diaphragm pumps appears in Wilden U.S. Pat. No. 4,339,985.

Normal Operation of an Air Operated Double Diaphragm Pump

Pressurized air at a selected pressure, such as 80 psi, is introduced to an air actuated double diaphragm pump P through an air inlet 10, filter 11 and passageway 12 to an actuator valve, broadly indicated at 13. The actuator valve 13 includes a valve spool 14 reciprocably mounted in a cylinder 15.

The cylinder 15 has openings 16, 17, 18, and 19 in its wall opposite the air passageway 12. The openings 16-19 provide communication between the interior of the cylinder 15 and air passageways 16A, 17A, 18A, and 19A in a center section 20 of the pump P.

The passageways 17A and 18A alternately deliver pressurized air to opposed air chambers 21 and 22 on the air sides of diaphragms 23 and 24 within diaphragm housings 23A and 24A on opposite sides of the pump P. The passageways 16A and 19A alternately handle air exhausted from the cylinder 15 as the valve spool 14 reciprocates between the seals 25 and 26 at the ends of the cylinder 15.

The valve spool 14 is activated by the pressurized air entering the cylinder 15 through the air inlet passageway 12. The inner end of the passageway 12 is elongated axially of the cylinder 15 as at 12A. The spool 14 has axially extending air passageways 27 and 28 axially spaced from each other and communicating respectively with the interior portions of the cylinder 15 between the spool 14 and the cylinder seals 25 and 26. Access ports 30 and 31 alternately provide communication between respective axially extending passageways 27 and 28 and the elongated portion 12A of the air inlet passageway 12.

The access ports 30 and 31 are spaced axially from each other a distance slightly greater than the length of the elongated portion 12A of the passageway 12, so that both of the access ports 30 and 31 will not register with and will not receive air from the passageway 12 at the same time.

Reciprocatory movement of the spool 14 is controlled by a control rod 32 extending between the diaphragms 23 and 24. The control rod 32 reciprocates within the center section 20 of the pump P responsive to the inward and outward movement of the diaphragms 23 and 24 as the air chambers 21 and 22 are alternately filled with air.

Depending on the position of the valve spool 14 in the cylinder 15, incoming air will be directed from the air inlet passageway 12 to either the air chamber 21 or the air chamber 22 of the double diaphragm pump P. If, as shown in FIG. 4, the valve spool 14 is against seal 26 at the bottom of the cylinder 15, the pressurized air moves from the enlarged portion 12A of the air inlet passageway 12 through an annular groove 33 around the medial portion of the spool 14 into port 18 in the wall of cylinder 15 and through passageway 18A to the air chamber 22 on the air side of diaphragm 24 (FIG. 7).

Figure 7:
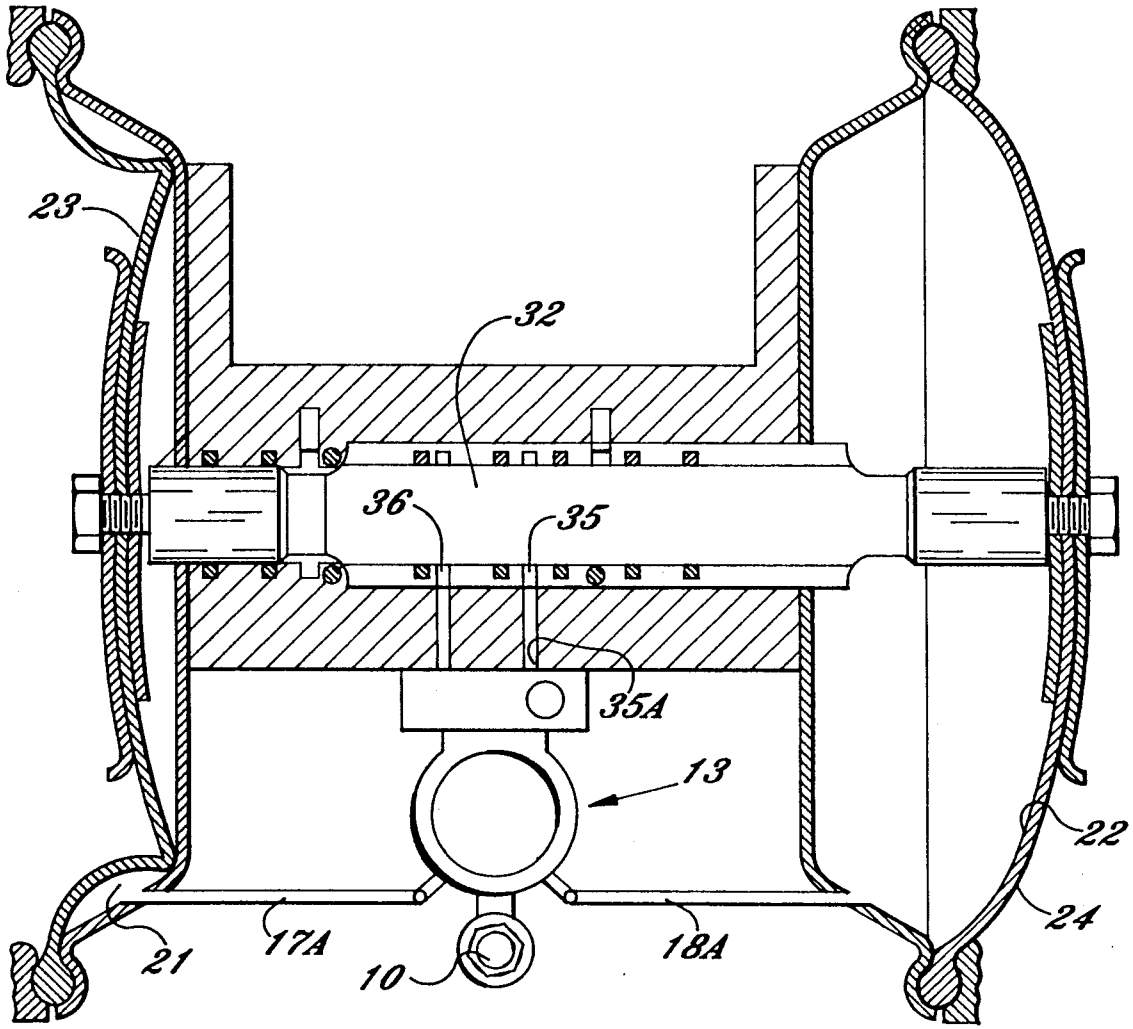
FIG. 7 is a sectional view taken substantially along the line 7—7 in FIG. 5.

The air pressure in air chamber 22 moves the diaphragm 24 outwardly as shown in FIG. 7, forcing slurry from the outlet 34 of the pump P. At the same time opposite diaphragm 23 is pulled in by the control rod 32 and the suction created by inward movement of the diaphragm 23 draws slurry into the supply chamber, not shown, outwardly of the diaphragm 23.

Figures 4, 5:
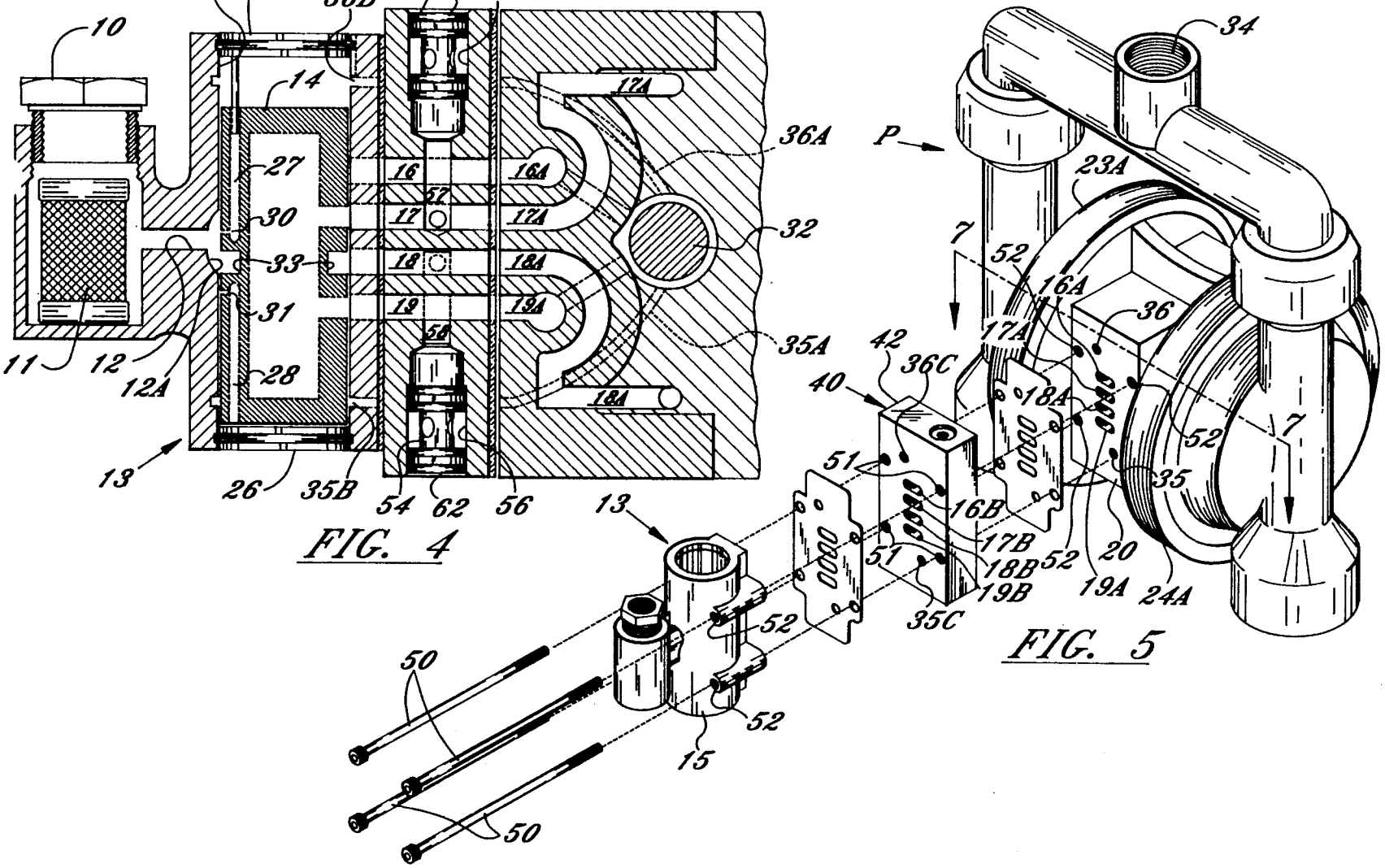
FIG. 4 is a sectional view taken substantially along the line 4—4 in FIG. 3.
FIG. 5 is an exploded perspective view illustrating the assembly of the over-ride valve assembly with an air operated double diaphragm pump.

When the pressurized diaphragm 24 reaches the limit of its stroke, the control rod 32 is positioned to release a pilot jet of two or three psi of air into the port 35 and through passageway 35A to port 35B in the wall of cylinder 15 near the bottom seal 26 in FIG. 4.

The pilot jet of air through the port 35B moves the spool 14 far enough from the seal 26 at the bottom of the cylinder 15 in FIG. 4 to align access port 31 in the spool 14 with the enlarged portion 12A of air inlet passageway 12, causing part of the incoming air pressure to move through axial port 28 and against the lower end of spool 14 in FIG. 4. Meanwhile air is exhausted from the opposite end portion of the cylinder between spool 14 and seal 25 as incoming air pressure moves through axial passageway 28 to the bottom of the spool to move the spool upwardly in FIG. 4. Most of the incoming air pressure moves through annular groove 33 and into port 17 as the spool reaches the limit of its upper stroke in FIG. 4. The incoming air pressure moves from port 17 through passageway 17A to fill the air chamber 21 on the air side of diaphragm 23 in FIG. 7.

Outward movement of the diaphragm 23 moves control rod 32 and diaphragm 24 to the left in FIG. 7 to release a pilot jet of two or three psi of air into the port 36 in center section 20 and through passageway 36A to port 36 B in the wall of cylinder 15 near the end seal 25 in FIG. 4. The process is repeated by the pilot jet of air through the port 36B moving the spool 14 away from the seal 25 at the top of the cylinder 15 in FIG. 4 enough to align access port 30 in the spool 14 with the enlarged portion 12A of air inlet passageway 12, causing part of the incoming air pressure to move through axial port 27 to the upper end of spool 14 in FIG. 4. Meanwhile air is exhausted from the opposite end portion of the cylinder between spool 14 and seal 26 as incoming air pressure moves through axial passageway 27 to the top of the spool to move the spool downwardly in FIG. 4. Most of the incoming air continues to move through annular groove 33 and enters port 18 to expand diaphragm 24 as the spool reaches the limit of its downward stroke in FIG. 4.

The foregoing description of operation is provided as background for a proper understanding of the significance of the structure and operation of the over-ride valve of the present invention.

The Invention

Figure 2:
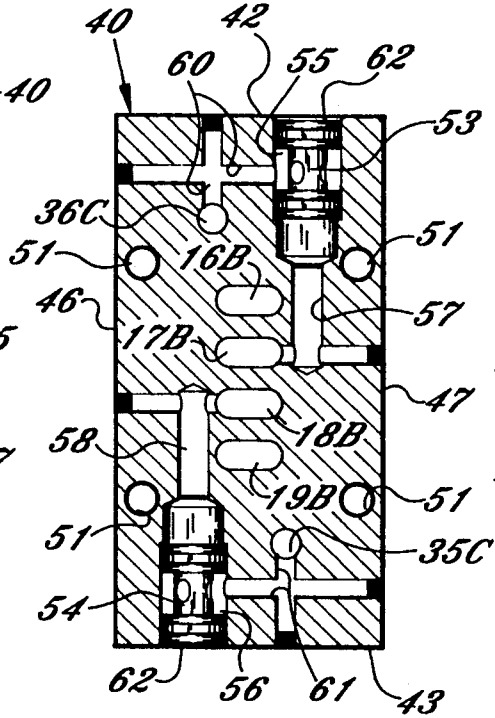
FIG. 2 is a sectional view of the over-ride valve assembly, taken substantially along the line 2—2 in FIG. 1.
Figure 1:
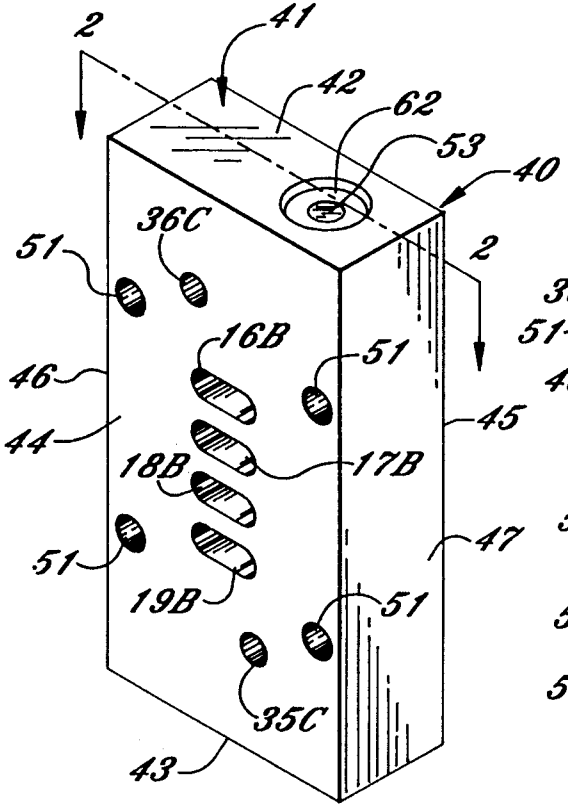
FIG. 1 is a perspective view of the over-ride valve assembly removed from the pump.
Figure 6:
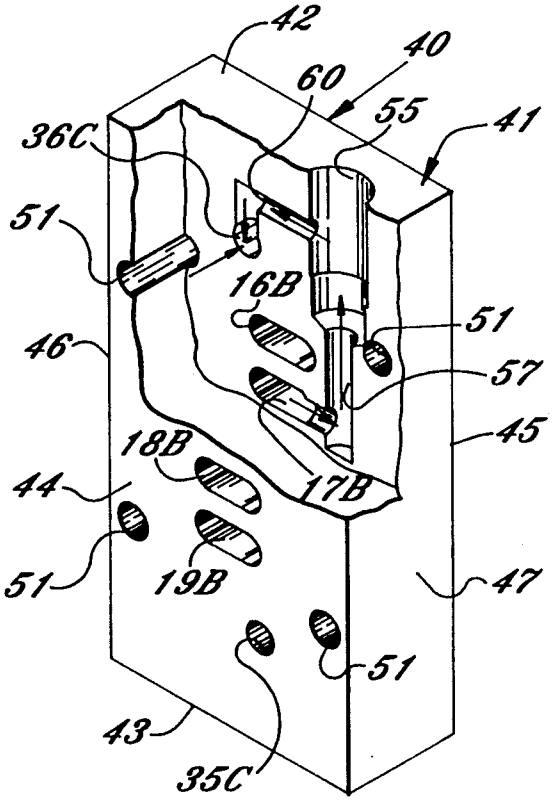
FIG. 6 is a perspective view of the over-ride valve removed from the pump and partially cut away to somewhat schematically illustrate the path of pressurized air through an opened over-ride valve to one end of a stalled spool.

The over-ride valve, broadly indicated at 40, is positioned in use between the actuator valve 13 and the center section 20, as best seen in FIGS. 3 and 5. FIGS. 1, 2, and 6 show the over-ride valve 40 removed from the air operated double diaphragm pump P.

The over-ride valve 40 comprises a housing, generally indicated at 41, and including a top wall 42, bottom wall 43, front wall 44, rear wall 45, and side walls 46 and 47. The cross-sectional dimensions of the over-ride valve 40 and the center section 20 are preferably the same, as indicated in FIG. 4, and, in use, the over-ride valve 40 is fastened by bolts 50 between the actuator valve 13 and the center section 20, as best seen in FIG. 5. The actuator valve 13 is, in the prior art, connected by bolts to the center section 20. The over-ride valve 40 has openings 51 communicating with its front wall 44 and rear wall 45 and registering with holes 52 provided for bolts in the actuator valve 13 and center section 20. The bolts 50 are enough longer than the bolts originally used to accomodate the thickness of the over-ride valve 40, and take advantage of the holes 52 provided for the bolts in the actuator valve 13 and center section 20.

The center portion of the housing 41 has four openings 16B, 17B, 18B, and 19B extending through the front and rear walls 44 and 45 of the housing and corresponding in shape and spacing with the four laterally elongated passageways 16A–19A in the center section 20. Two other openings 35C and 36C extend through the housing 41 of the over-ride valve in communication with its front and rear walls 44 and 45. The openings 35C and 36C and the laterally elongated openings 16B-19B serve as passageways through the over-ride valve 40 to effectively connect the actuator valve 13 with the center section for the previously described normal operation of the air operated double diaphragm pump P, as in the prior art.

Normally closed two-way air valves 53 and 54 are provided in the housing 41. Air valve 53 communicates with the top wall 42 and extends inwardly therefrom. Air valve 54 communicates with the bottom wall 43 and extends inwardly therefrom. A valve chamber 55 is provided in the housing 41 for the air valve 53, and a valve chamber 56 is provided for air valve 54. The valve chamber 55 for valve 53 communicates with the passageway 17A for pressurized air through a vertical bore 57 (FIG. 6) and the valve chamber 56 for valve 54 communicates with the passageway 18A for pressurized air through a vertical bore 58, as best seen in FIG. 4.

An L-shaped passageway 60 extends from the upper portion of valve chamber 55 to provide communication between the opening 36C, through the valve chamber 55, with the vertical bore 57. An L-shaped passageway 61 extends from the lower portion of valve chamber 56 to provide communication between the opening 35C, through the valve chamber 56, with the vertical bore 58.

The valves 53 and 54 are closed during normal operation of the air operated double diaphragm pump to prevent communication between the passageways 17A and 18A for pressurized air and respective openings 35C and 36C through the over-ride valve for the pilot jets of air to the ends of the valve spool 14.

When, as sometimes happens because of foreign matter or low air pressure, the valve spool 14 stalls between the seals 25 and 26 at the ends of the cylinder 15, and stops the double diaphragm pump, the over-ride valve 40 may be activated by manually depressing the exterior portion 62 of the over-ride valve 53 for example. Opening of valve 53 establishes communication of pressurized air passageway 17A, through opening 36C, with the portion of the cylinder 15 near the seal 25. The release of fully pressurized air against the end of the spool through the opened valve 53 normally starts the double diaphragm pump. If not, the valve 54 may be opened by manually depressing its exterior portion 62 to admit pressurized air from the passageway 18A through opening 35C and against the other end of the spool 14 to start the pump P.

There is thus provided a manually operable over-ride valve assembly to effectively and easily restart an air operated double diaphragm pump which has stalled. Although specific terms have been used in describing the invention, they have been used in a descriptive sense only and not for the purpose of limitation.

I claim:

1. An air actuated double diaphragm pump having opposed diaphragm housings, each housing having a diaphragm and each diaphragm having an air side proximal to the opposed diaphragm, an actuator valve with a reciprocable valve spool connected to a source of pressurized air and pressurized air passageways extending from the actuator valve to the air sides of opposed diaphragms, the improvement which comprises means for selectively diverting pressurized air from the air side of one diaphragm and directing the diverted pressurized air against one end of the valve spool to restart the pump after the valve spool has stalled.

2. The improvement of claim 1 wherein additional means are provided for selectively diverting pressurized air from the air side of the opposing diaphragm and directing the diverted pressurized air against the other end of the valve spool to restart the pump after the valve spool has stalled.

3. The improvement of claim 1 wherein said means comprises an over-ride valve assembly for attachment between the air operated double diaphragm pump and the actuator valve, said over-ride valve assembly comprising a housing having open passageways communicating with opposite sides of the over-ride valve and normally providing communication for the passage of pressurized air from the actuator valve to the air sides of opposed diaphragms, said housing also having a group of internal air passageways communicating with its open passageways and with passageways in the actuator valve and arranged to deliver pressurized air to one end of the actuator valve, and a manually operable normally closed two-way air valve mounted in the housing and normally blocking delivery of pressurized air from the over-ride valve assembly to the actuator valve, whereby said two-way air valve may be manually opened to deliver pressurized air to one end of the actuator valve to restart a stalled pump.

4. The improvement of claim 3 wherein said housing has a second group of internal air passageways communicating with its open passageways and with passageways in the actuator valve and arranged to deliver pressurized air to a second end of the actuator valve, and a second manually operable normally closed two-way air valve mounted in the housing and normally blocking delivery of pressurized air from the second group of internal air passageways to the actuator valve, whereby one of said two-way air valves may be manually opened to deliver pressurized air to an end of the actuator valve to restart a stalled pump.

* * * * *